US009039424B2

(12) United States Patent
Camelio et al.

(10) Patent No.: US 9,039,424 B2
(45) Date of Patent: May 26, 2015

(54) CLOSED ENTRY DIN JACK AND CONNECTOR WITH PCB BOARD LOCK

(71) Applicant: Winchester Electronics Corporation, Wallingford, CT (US)

(72) Inventors: David J. Camelio, Foxboro, MA (US); John E. Benham, Torrington, CT (US)

(73) Assignee: Winchester Electronics Corporation, Middlebury, CT (US)

( * ) Notice: Subject to any disclaimer, the term of this patent is extended or adjusted under 35 U.S.C. 154(b) by 272 days.

(21) Appl. No.: 13/655,718

(22) Filed: Oct. 19, 2012

(65) Prior Publication Data

US 2013/0102187 A1 Apr. 25, 2013

Related U.S. Application Data

(60) Provisional application No. 61/548,887, filed on Oct. 19, 2011.

(51) Int. Cl.

| | |
|---|---|
| ***H01R 12/00*** | (2006.01) |
| ***H01R 24/50*** | (2011.01) |
| *H01R 13/631* | (2006.01) |
| *H01R 24/44* | (2011.01) |

(52) U.S. Cl.

CPC ..... *H01R 24/50* (2013.01); *H01R 13/631* (2013.01); *H01R 24/44* (2013.01)

(58) Field of Classification Search

CPC .. H01R 24/50; H01R 9/0515; H01R 23/7073; H01R 24/44; H01R 23/6873; H01R 12/721; H01R 12/57

USPC ..... 439/63, 581, 578, 582

See application file for complete search history.

(56) References Cited

U.S. PATENT DOCUMENTS

| | | | | |
|---|---|---|---|---|
| 4,281,555 | A | 8/1981 | Schluntz et al. | |
| 4,611,878 | A | 9/1986 | Hall et al. | |
| 6,164,977 | A * | 12/2000 | Lester | 439/63 |
| 6,227,908 | B1 | 5/2001 | Aumeier et al. | |
| 6,695,636 | B2 * | 2/2004 | Hall et al. | 439/352 |
| 6,719,586 | B2 * | 4/2004 | Weidner | 439/581 |
| 6,780,051 | B2 * | 8/2004 | Otsu | 439/578 |
| 6,913,488 | B2 * | 7/2005 | Motojima et al. | 439/607.01 |
| 7,909,615 | B1 | 3/2011 | Yasumura et al. | |
| 8,550,855 | B2 * | 10/2013 | Zhang et al. | 439/636 |

OTHER PUBLICATIONS

International Search Report and Written Opinion issued on Jan. 11, 2013 in corresponding International application No. PCT/US2012/060993, 14 pages.

* cited by examiner

*Primary Examiner* — Xuong Chung Trans

(74) *Attorney, Agent, or Firm* — Rothwell, Figg, Ernst & Manbeck, P.C.

(57) ABSTRACT

The present invention provides a DIN jack including a dielectric shroud defining a closed entry lead-in that helps prevent damage caused by a bent or misaligned signal pin of a mating DIN plug without adversely affecting the performance of the DIN connector. The present invention also provides a board lock feature that may be used to hold a DIN jack securely to a circuit board during the manufacturing process.

30 Claims, 7 Drawing Sheets

CLOSED ENTRY DIN JACK AND CONNECTOR WITH PCB BOARD LOCK

CROSS-REFERENCE TO RELATED APPLICATIONS

This application claims the benefit of U.S. Provisional Patent Application Ser. No. 61/548,887, filed on Oct. 19, 2011, the disclosure of which is incorporated herein in its entirety.

FIELD OF THE INVENTION

The present invention relates generally to electrical connectors.

BACKGROUND

Electrical connectors designed to interface in compliance with standards established by the Deutsches Institut fur Normung, a German standards organization, are referred to as DIN connectors. FIG. 1 shows a standard DIN 1.0/2.3 connector 100. The DIN connector 100 includes a DIN plug 102 with a signal pin 104 and a DIN jack 106 with a mating socket contact 108 axially aligned with the signal pin. Signal pin 104 and socket contact 108 are disposed within respective hollow, cylindrical shields 110, 112 that mate telescopically. Problems have been noted when this type of connector is miniaturized for use in a large array of connectors. For example, if the signal pin of a DIN plug is bent or misaligned even a small amount (e.g., more than 0.006"), it can brush by or butt against and damage the DIN jack with resulting signal loss and reliability problems.

SUMMARY

Embodiments of a first aspect of the present invention provide a jack (e.g., a DIN jack or other jack) including a tubular socket disposed coaxially within a hollow cylindrical shield and a closed entry lead-in that helps prevent damage to the socket caused by a bent or misaligned signal pin without adversely affecting the impedance of the connector.

In some embodiments of the jack, the lead-in is defined at the distal end of a shroud formed of a dielectric material. The shroud has a tubular shroud portion with proximal and distal ends disposed coaxially around the socket and is radially spaced from both the socket and the shield. In some embodiments, one or more openings are formed laterally through the shroud.

In some embodiments of the jack, the shroud includes a rim extending radially inward from the distal end of tubular shroud portion and defining a frustoconical lead-in coaxially aligned with the socket.

In some embodiments of the jack, the proximal end of the tubular shroud portion is coupled with the cylindrical shield or some other part of the connector body.

In some embodiments of the jack, the shroud includes an annular base extending radially outward from the proximal end of the hollow tubular shroud body and coupled with the connector body.

In some embodiments of the jack, an annular groove is formed along an inner surface of the cylindrical shield and the annular base of the shroud is received within the annular groove.

In some embodiments of the jack, at least some of the openings in the shroud are longitudinally spaced along a length of the tubular shroud portion, and/or annularly spaced about a circumference of the tubular shroud body.

In some embodiments of the jack, the openings are arranged in a plurality of longitudinal rows equiangularly spaced about a circumference of the tubular shroud body.

In some embodiments of the jack, the one or more openings are configured to modify a dielectric constant of the shroud to support 75Ω transmission of high-speed digital or RF signals.

In some embodiments, the frustoconical lead-in has a proximal opening with a diameter no more than 0.003" larger than the inner diameter of the tubular socket and a distal opening larger than the inner diameter of the tubular socket.

In some embodiments, the shroud is formed of a liquid crystal polymer.

In some embodiments, one or more board locks protrude from the connector body and include at least one outwardly biased resilient finger with a rearward-facing shoulder configured to engage a bottom surface of a printed circuit board when the board lock is inserted through a hole in the printed circuit board.

In some embodiments, a pair of board locks are arranged in diagonally opposed relation relative to a longitudinal axis of the jack, alone or in combination with one or more mounting pins or posts.

Embodiments of a second aspect of the present invention provide a DIN connector having a jack with a shroud as described above and a mating DIN plug having a second connector body with a second hollow cylindrical shield configured to be received in the space between the shroud and the first hollow cylindrical shield and to make electrical contact with the first shield; and a second contact having a pin disposed coaxially within the second hollow cylindrical shield and being configured to be received within and make electrical contact with the tubular socket when the plug is inserted into the jack.

Other aspects of the present invention provide a connector jack with a shroud as described above, and connectors utilizing such connector jacks.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

DETAILED DESCRIPTION

Figure 1:
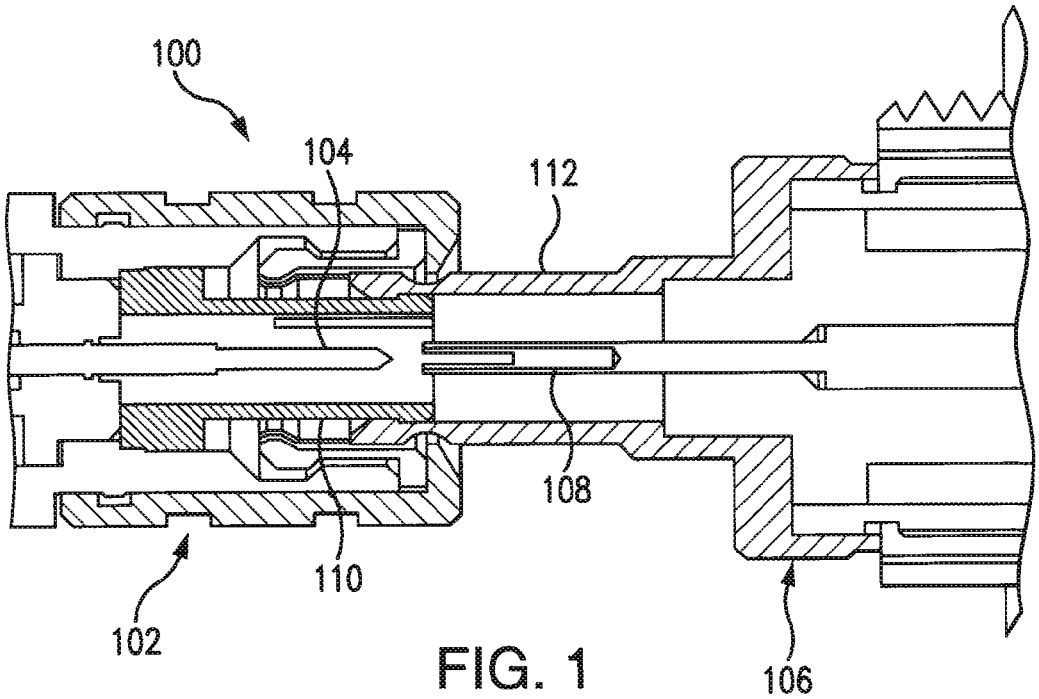
FIG. 1 PRIOR ART
FIG. 1 is a sectional side view of a prior art DIN connector showing a DIN plug partially mated with a DIN jack.
Figure 2:
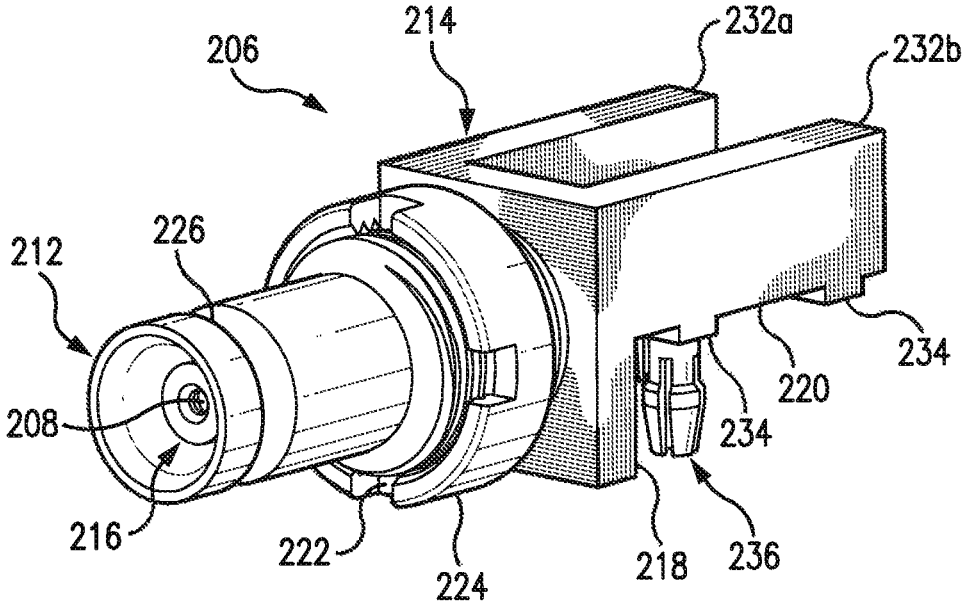
FIG. 2 is a perspective view of a DIN jack according to an embodiment of the invention.
Figure 3:
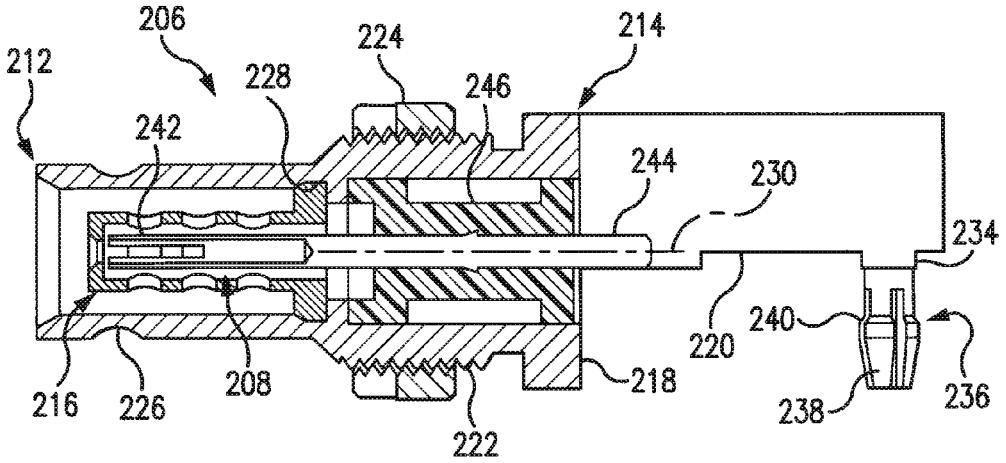
FIG. 3 is a sectional side view of the DIN jack shown in FIG. 1 taken along line 2-2.
Figure 5:
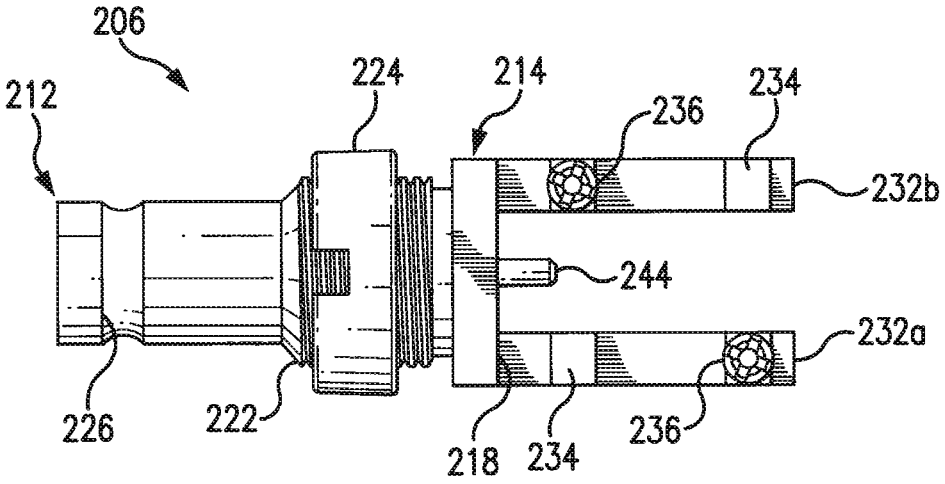
FIG. 5 is a bottom view of the DIN jack shown in FIGS. 2 and 3.

A DIN jack 206 according to an embodiment of the invention, shown in FIGS. 2, 3 and 5, includes a connector body 214, a contact 208, and a shroud 216 that helps prevent damage to the contact while maintaining RF signal return loss performance. In this embodiment, the connector body 214 is configured to allow the DIN jack to be edge mounted on a printed circuit board (PCB).

The connector body 214 is formed of an electrically conductive material (e.g., brass) and, as best seen in FIG. 3, includes a distal portion defining a hollow cylindrical shield 212 with an open distal end, a proximal portion defining a proximal face 218 and one or more downward-facing board mounting surfaces 220 perpendicular to the proximal face 218, and a threaded portion 222 of hollow cylindrical configuration with external screw threads between the proximal and distal portions. A mounting nut 224 is preferably provided on the threaded portion 222 of the connector body for use in mounting the jack to a panel.

Referring still to FIG. 3, the cylindrical shield includes a first annular groove 226 formed about an outer circumference of the shield near the distal end, and a second annular groove 228 formed about an inner circumference of the shield near the proximal end. The board mounting surfaces 220 are preferably planar and oriented parallel to and in alignment with the central longitudinal axis 230 of the cylindrical shield to align the center of the shield with the edge of a PCB when the mounting surfaces 220 abut the top of the PCB. Referring to FIGS. 3 and 5, the board mounting surfaces 220 are defined along respective bottom edges of two parallel arms 232*a* and 232*b* oriented parallel to the longitudinal axis 230 of the connector and laterally spaced apart. Two posts 234 are shown extending downwardly from the bottom edge of each arm, and the planar mounting surfaces 220 are disposed between the posts 234.

A board lock 236 extends downwardly from one of the two posts 234 on each arm. Preferably, the board locks 236 are located on alternate posts so that, when viewed from the bottom as shown in FIG. 5, the board locks 236 are arranged in diagonally opposed relation (e.g., longitudinally and laterally spaced from one another). Each board lock includes a plurality of outwardly biased fingers or tines 238 combining to form a generally frustoconical insert with upwardly facing shoulders 240 configured to abut a bottom of the PCB when the board lock is inserted through a hole in the PCB and the mounting surfaces 220 abut the top of the PCB. The board locks 236 can be formed of any conductive material with suitable elasticity, e.g., phosphor bronze per ASTM 8139.

In the embodiment shown, the posts 234 without board locks are also arranged in diagonally opposed relation. In an embodiment, a post without a board lock on one arm is longitudinally aligned with a board lock on the other arm. It has been found that this arrangement helps meet spatial requirements by facilitating proper positioning and alignment of the connector on the PCB and by securely holding the jack in place during the soldering process.

As best seen in FIG. 3, the contact includes a tubular socket 242 with an open distal end disposed coaxially within the hollow cylindrical shield 212. The tubular socket 242 is of much smaller diameter than the shield 212, so the socket and shield are separated by an annular gap. In an embodiment, the tubular socket 242 has an outer diameter of 0.03 inches and an inner diameter of 0.02 inches, and the hollow cylindrical shield 212 has an inner diameter of 0.11 inches. A solder tail 244, preferably having the same outer diameter as the tubular socket 242, extends longitudinally from the tubular socket 242 in a proximal direction to protrude slightly from the proximal face 218 of the housing between the parallel arms at the proximal end of the housing. The contact 208 can be formed of any suitable electrically conductive material, e.g., a copper alloy, and is held in place by a sleeve 246 formed of an insulating material, e.g., PTFE (Teflon), disposed within the connector body 214. In the embodiment shown, a lower edge of the solder tail 244 is slightly below the plane defined by the mounting surfaces 220. In a preferred embodiment, a central longitudinal axis 230 of the solder tail 244 is coplanar with the mounting surfaces 220.

Figure 4:
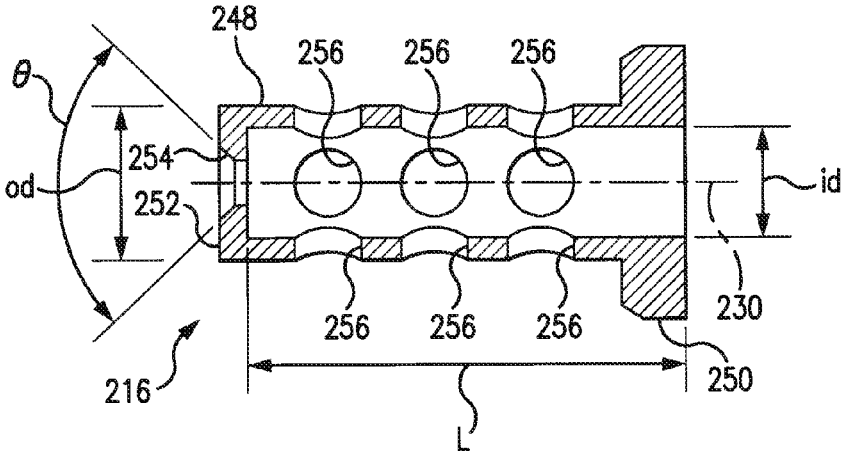
FIG. 4 is a sectional side view of a shroud for use in a DIN jack according to an embodiment of the invention.

Referring now to FIGS. 3 and 4, the shroud 216 is formed of a dielectric material and includes a tubular shroud portion 248 with proximal and distal ends, and an annular base 250 extending radially outward from the proximal end of the tubular shroud portion 248. An outer edge of the annular base 250 is received within the annular groove 228 formed along the inner circumference of the cylindrical shield. The tubular shroud portion 248 extends coaxially around the contact socket 208 within the annular gap between the socket and the shield and is held in radially spaced relation to the socket and the shield so as to define first and second radial gaps therebetween. In an embodiment, the first radial gap (between the shroud 216 and the socket contact 208) is 0.005-0.015 inches, or preferably 0.01 inches, and the second radial gap (between the shroud 216 and the shield 212) is 0.015-0.025 inches, or preferably 0.02 inches.

In the embodiment shown, the shroud 216 includes a rim 252 extending radially inward from the distal end of tubular shroud portion 248 and defining a frustoconical lead-in 254 coaxially aligned with the socket. In an embodiment, the diameter of the lead-in decreases from 0.036 inches to 0.022 inches in the proximal direction, and the included angle θ of the lead-in is 90 degrees. In the case of the foregoing embodiment, the shroud 216 allows the socket 242 to be used with pins that are axially misaligned as much as 0.018 inches more than a standard connector socket. The lead-in terminates proximally in a straight through-hole having a diameter equal to the proximal diameter of the frustoconical opening, preferably 0.022 inches, which is only slightly larger than the inner diameter of the tubular socket 242 (preferably 0.02 inches). By interposing the lead-in between the socket and a mating plug with pin contact, the shroud 216 helps eliminate damage caused by a misaligned pin contact butting against or sliding past the socket.

Referring specifically to FIG. 4, it can be seen that the tubular shroud portion 248 has a wall thickness and a plurality of openings 256 that are formed laterally (i.e., perpendicular to the longitudinal axis 230) through the thickness of the wall. The wall thickness and number, size and location of the openings 256 are selected to produce a desired characteristic impedance. In some embodiments, (as illustrated by the dimensions shown in FIG. 4) the wall thickness of the tubular shroud portion 248 is about 0.01 inches (e.g., as shown in FIG. 4 the outer diameter (od) is about 0.073 inches and the inner diameter (id) is about 0.053 inches; as also shown the length (L) of the tubular shroud portion is about 0.175 inches in some embodiments, in other embodiments the length is less than 0.5 inches). In some embodiments, the wall thickness of portion 248 ranges from 0.01 inches to 0.1 inches. In the embodiment shown, twelve circular openings 256 are formed through the shroud 216 in four longitudinal rows spaced equiangularly about the circumference of the shroud 216. In a preferred embodiment, each row includes three circular holes of 0.031 inch diameter spaced 0.05 inch apart center-to-center. In a preferred embodiment, counterpart openings 256 in adjacent rows are longitudinally aligned. The shroud 216 can be formed of any dielectric material that meets the thermal and mechanical requirements of the application. In particular, the shroud material is preferably hard enough for the lead-in to guide a misaligned pin to the socket without breaking and for the tubular shroud portion to resist bending when a misaligned pin slides against it. In addition, the shroud material preferably supports 75Ω transmission of high-speed digital (e.g., up to 6 Gbps) and radio frequency (RF) signals while maintaining RF signal return performance better than −25 dB to 5 GHz. In an embodiment, the invention supports up to 6 GHz and performance requirements per SMPTE-424 3 Gbit/s 3G-SDI broadcast signaling. In a preferred embodiment, the shroud 216 is formed of a dielectric material having a heat deflection temperature greater than 260° C. (more preferably, 280° C.) and a compression strength of at least 15 lbs (measured perpendicular to the longitudinal axis of the tubular shroud portion). In an embodiment, the shroud 216 is formed of a polyethermide, such as Ultem 1000 (unfilled). In a preferred embodiment, the shroud 216 is formed of a liquid crystal polymer (LCP); and, more preferably, a glass-filled LCP, such as Zenite 6130LX BK010.

Figure 6:
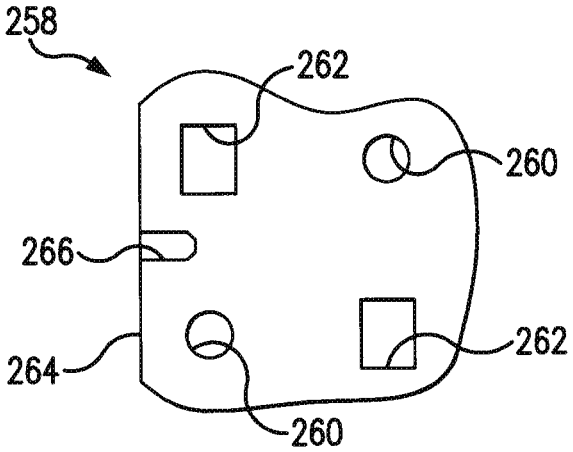
FIG. 6 is a plan view of a printed circuit board configured to mount the DIN jack shown in FIGS. 2, 3 and 5.

FIG. 6 shows an edge portion of a PCB 258 with two pairs of diagonally opposed mounting holes 260 and 262 to receive the board locks 236 and alignment posts 234, respectively. The mounting holes are spaced from the edge 264 of the PCB so that the proximal face 218 of the connector body 214 abuts the edge of the PCB when the board locks 236 and posts 234 are inserted through the mounting holes. The PCB also includes a small longitudinal trough 266 extending proximally from the edge of the PCB to receive the solder tail 244 when the DIN jack is mounted on the edge of the PCB. In an embodiment, the mounting holes are plated through holes. In an embodiment, the PCB is 0.063 inches thick. In an embodiment, at least some, and preferably all, of the mounting holes are plated through-holes.

In use, DIN jack 206 can be edge-mounted on a PCB by aligning the board locks 236 and posts 234 on the connector body 214 with corresponding holes in the PCB and pressing the jack and the PCB towards one another. As the jack and the PCB are pressed together, the tines of the board locks 236 will be deflected radially inwardly by the walls of the through holes and will spring radially outward once free from the hole to cause the PCB to be sandwiched between the bottom edges of the connector body 214 and the upwardly facing shoulders of the board locks 236. The spacing of the holes from the edge of the PCB also ensures that the proximal face 218 of the connector body 214 is closely adjacent to or in contact with the edge of the PCB, so that in combination with the board locks 236 and posts 234, the jack is held firmly in place and unable to move excessively in any direction. Once properly positioned, the solder tail 244 is preferably disposed within the trough formed at the edge of the board, between the connector arms, accessible for soldering. The jack 206 is then soldered to the board. The board lock feature also improves the manufacturing process by securing the jack so that there is no need to fixture a single jack or an array of jacks to the PCB during wave or reflow soldering. The board locks 236 also reduce manufacturing time by increasing the efficiency of placement and holding the jack 206 securely to the circuit board while the PCB is handled and soldered. In an embodiment, the shroud is formed of a material with sufficient heat deflection temperature to avoid becoming misaligned during the soldering process.

Figure 7:
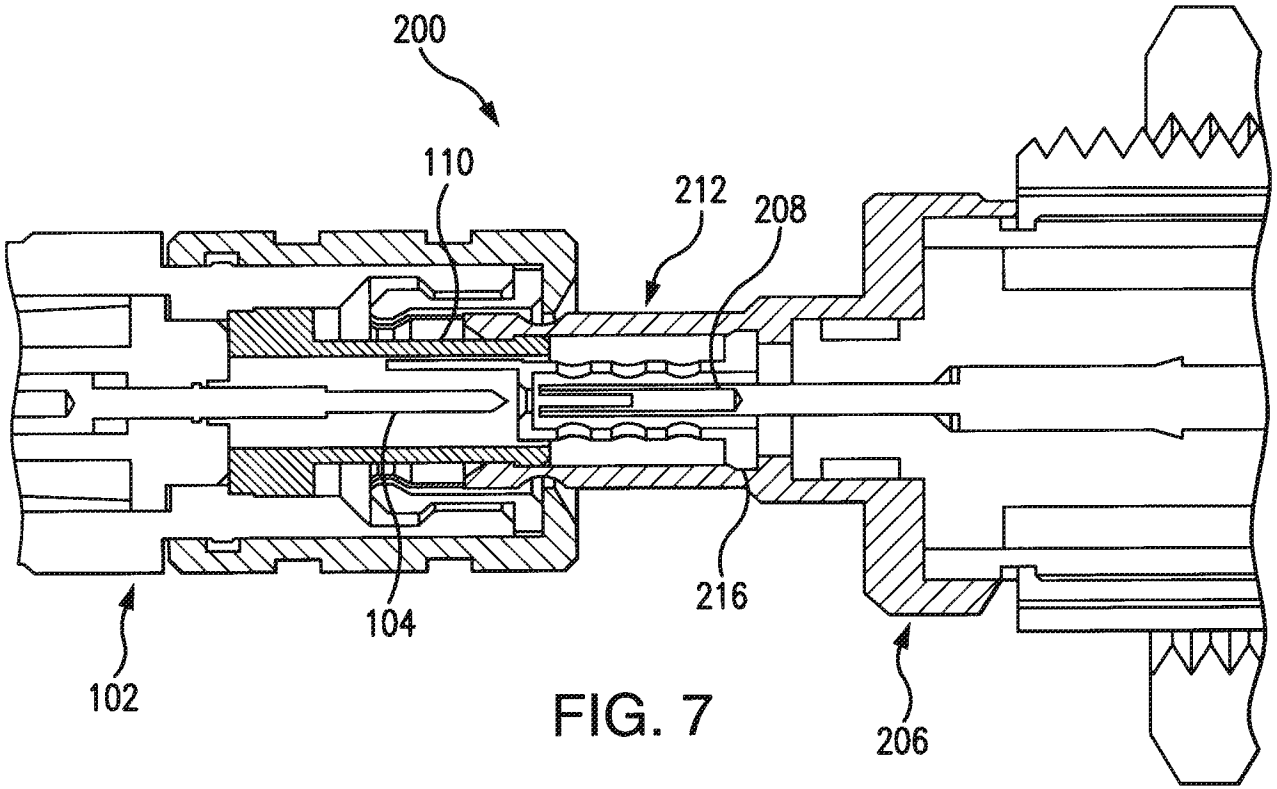
FIG. 7 is a sectional side view of a DIN 1.0/2.3 connector with a DIN jack according to an embodiment of the invention.

It will be appreciated that the DIN jack 206 of the present invention can interface with a standard DIN plug 102 as shown in FIG. 7. The pin 104 of the DIN plug 102 is received within the tubular socket 242, and the cylindrical shield 110 of the plug is received within the gap between the shroud 216 and the cylindrical shield 112 of the jack.

Figure 8:
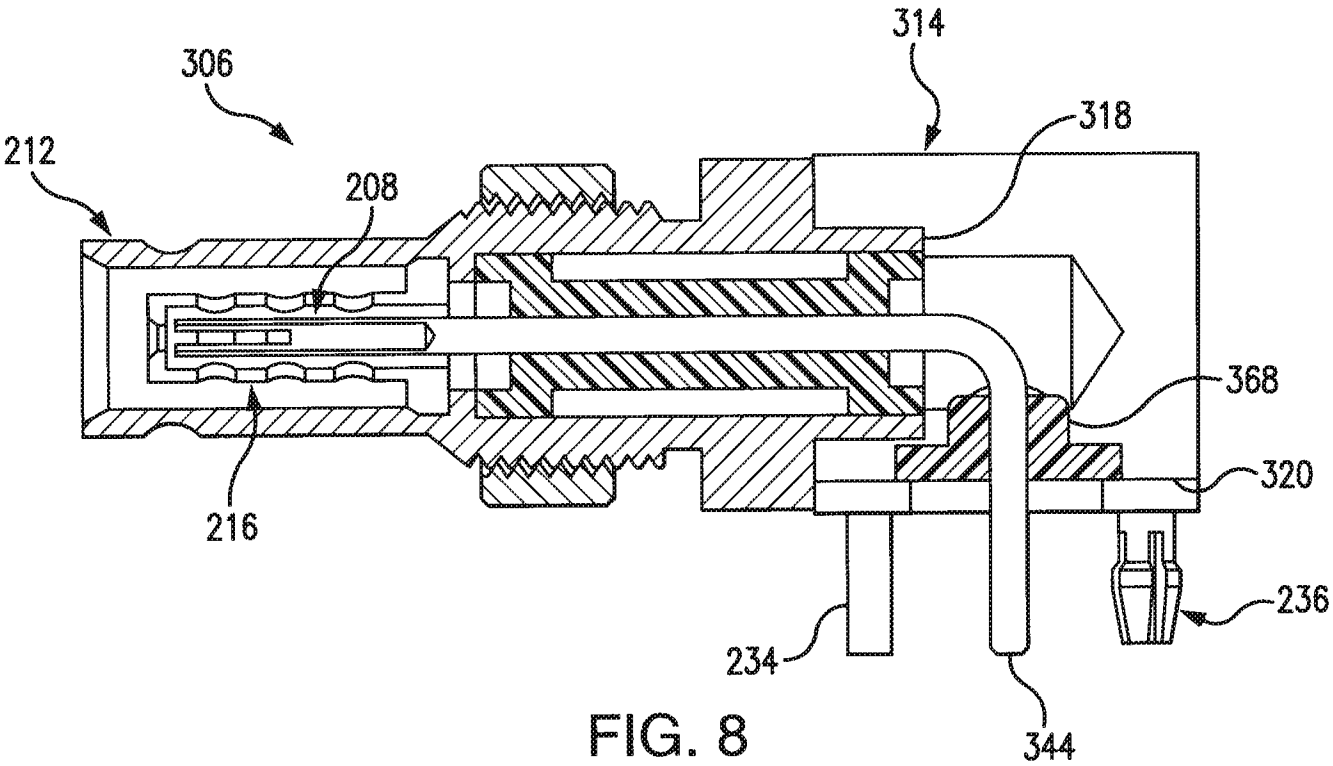
FIG. 8 is a sectional side view of a right angle DIN jack according to an embodiment of the invention for panel mounting on a printed circuit board.

A right angle DIN jack 306 according to another embodiment of the invention, for panel mounting on a printed circuit board, is shown in FIG. 8. The DIN jack 300 includes a hollow cylindrical shield 212, a tubular socket 242, and a shroud 216 like the DIN jack 206 shown in FIGS. 2-5; however, the connector body 314 and solder tail 344 are configured to facilitate panel mounting on a PCB. Specifically, the connector body 314 includes a cube-like proximal portion defining a single board mounting surface 320 laterally spaced from the central longitudinal axis 230 of the shield so that the jack interface (and the nut) is elevated from the surface of the PCB. In this embodiment, the solder tail 344 extends from the proximal face 318 of the connector body and bends 90 degrees downward towards to the PCB. A second insulator 368 holds the solder tail 344 in position between the board locks 236 and the posts 234. This DIN jack can be surface mounted on a PCB having mounting holes like the ones shown in FIG. 6, but with the addition of a central plated through-hole for the solder tail.

Figure 9:
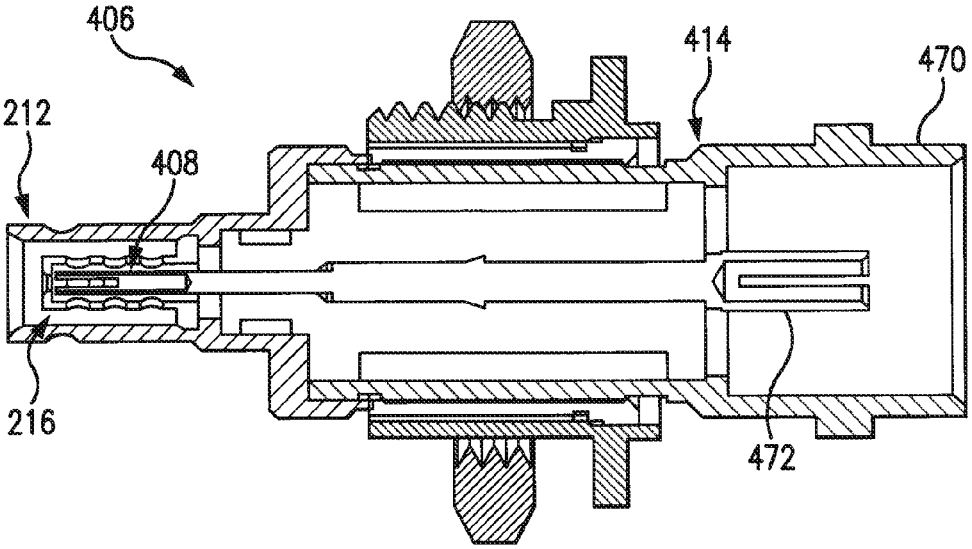
FIG. 9 is a sectional side view of a DIN to BNC adapter utilizing a DIN jack according to an embodiment of the invention.

In another embodiment of the present invention, shown in FIG. 9, a DIN to BNC adapter 406 is provided. The adapter 406 includes a hollow cylindrical shield 212, a tubular socket 242, and a shroud 216 like the DIN jack 206 shown in FIGS. 2-5; however, proximal ends of the connector body 414 and the contact 408 are configured to define the shield 470 and socket 472 of a BNC jack.

Figure 10:
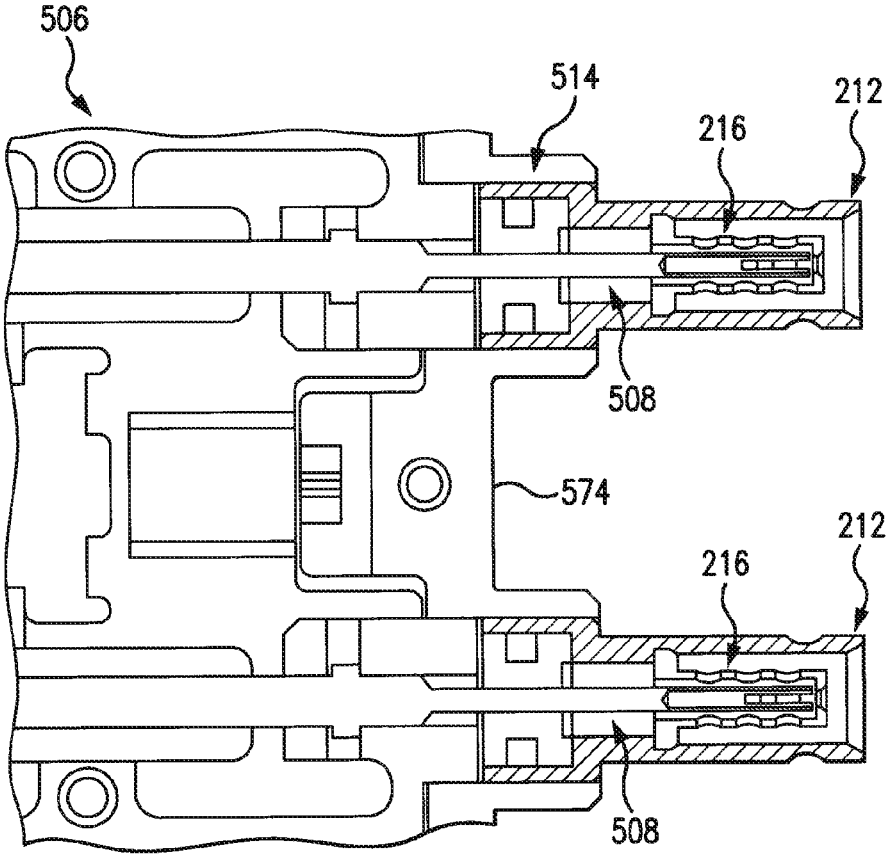
FIG. 10 is a sectional side view of a DIN jack for video applications according to an embodiment of the invention.

In yet another embodiment, shown in FIG. 10, a DIN video jack 506 is provided. The DIN video jack 506 includes a hollow cylindrical shield 212, a tubular socket 242, and a shroud 216 like the DIN jack 206 shown in FIGS. 2-4; however, proximal ends of the connector body 514 and the contact 508 are configured to interface with high definition video equipment 574.

While various embodiments of the present invention have been described above, it should be understood that they have been presented by way of example only, and not limitation. For example, while the shroud is shown as an integral, one-piece unit, it will be appreciated that the shroud can be made-up of multiple pieces that are bonded, fused, or otherwise connected together to form an integral unit. Also, while certain adapters are shown for converting between DIN and other interfaces, it will be appreciated that other adapters can be made using the DIN jack of the present invention. For example, the DIN jack can be used in a DIN jack to BNC plug. Further, while specific sheath openings are disclosed herein, it will be appreciated that other shapes, sizes, and/or numbers of openings can be used. Also, the arrangement of the openings can be modified. For example, the number of longitudinal rows of openings may be greater or fewer than shown, and the openings in adjacent rows may be longitudinally aligned as shown, or staggered. It will also be appreciated that, although the invention has been described with reference to the DIN 1.0/2.3 interface, the present invention may be embodied in other types of jacks and connector interfaces used in high-speed digital and RF applications. Additionally, the board lock feature may be used on a jack, as shown, or a plug. Thus, the breadth and scope of the present invention should not be limited by any of the above-described exemplary embodiments.

The invention claimed is:

1. A DIN jack comprising:

a connector body having a hollow cylindrical shield with an open distal end;

a contact having a tubular socket with an open distal end disposed coaxially within said hollow cylindrical shield, said socket and said shield being spaced from one another to define a first gap therebetween; and a shroud formed of a dielectric material and having a tubular shroud portion with proximal and distal ends disposed coaxially around said socket within said first radial gap, wherein said tubular shroud portion is spaced from said socket to define a second radial gap between said tubular shroud portion and said socket, said second radial gap extending along the entire length of said tubular shroud portion, said tubular shroud portion is spaced from said shield to define a third radial gap between said tubular shroud portion and said shield, said third radial gap extending along the entire length of said tubular shroud portion, said tubular shroud portion has a plurality of openings formed laterally therethrough, wherein said plurality of openings are arranged in a plurality of longitudinal rows spaced about a circumference of said tubular shroud portion, and said tubular shroud portion has a rim extending radially inward from said distal end of tubular shroud portion and defining a frustoconical lead-in coaxially aligned with said socket.

2. The DIN jack of claim 1, wherein said proximal end of said tubular shroud portion is coupled with said connector body.

3. The DIN jack of claim 2, wherein said shroud further includes an annular base extending radially outward from said proximal end of said hollow tubular shroud body and said annular base is coupled with said connector body.

4. The DIN jack of claim 3, wherein an annular groove is formed along an inner surface of said cylindrical shield and said annular base of said shroud is received within said annular groove.

5. The DIN jack of claim 1, wherein the second radial gap ranges between 0.005 and 0.015 inches and the third radial gap ranges between 0.015 and 0.025 inches.

6. The DIN jack of claim 1, wherein at least some of said openings are longitudinally spaced along a length of said tubular shroud portion.

7. The electrical connector of claim 1, wherein at least some of said openings are annularly spaced about a circumference of said tubular shroud body.

8. The DIN jack of claim 5, wherein the thickness of the tubular shroud portion is about 0.010 inches.

9. The DIN jack of claim 1, wherein said one or more openings are configured to modify a dielectric constant of said shroud to support 75Ω transmission of high-speed digital and RF signals.

10. The DIN jack of claim 1, wherein said distal end of said tubular socket has an inner diameter and wherein said frustoconical lead-in has a proximal opening with a diameter no more than 0.003" larger than said inner diameter of said tubular socket and a distal opening larger than said inner diameter of said tubular socket.

11. The DIN jack of claim 1, wherein said shroud is formed of a material having a heat deflection temperature greater than 260° C. and a compression strength of at least 15 lbs.

12. The DIN jack of claim 1, wherein said shroud is formed of a liquid crystal polymer.

13. The DIN jack of claim 1, wherein said connector body further includes a plane surface and one or more board locks protruding from said plane surface, each of said one or more board locks including at least one outwardly biased resilient finger with a rearward-facing shoulder configured to engage a bottom surface of a printed circuit board when said board lock is inserted through a hole in the printed circuit board.

14. The DIN jack of claim 13, wherein said connector body includes a pair of said one or more board locks arranged in diagonally opposed relation relative to a longitudinal axis of said plane surface.

15. The DIN jack of claim 14, wherein said connector body includes one or more mounting pins protruding from said plane surface in diagonally opposed relation to said one or more board locks.

16. A DIN connector comprising:

a DIN jack including:

a first connector body having a first hollow cylindrical shield with an open distal end;

a first contact having a tubular socket with an open distal end disposed coaxially within said first hollow cylindrical shield, said socket and said shield being spaced from one another to define a first gap therebetween; and a shroud formed of a dielectric material and having a tubular shroud portion with proximal and distal ends disposed coaxially around said socket within said first radial gap, wherein said tubular shroud portion is spaced from said socket to define a second radial gap between said tubular shroud portion and said socket, said second radial gap extending along the entire length of said tubular shroud portion said tubular shroud portion is spaced from said shield to define a third radial gap between said tubular shroud portion and said shield, said third radial gap extending along the entire length of said tubular shroud portion, said tubular shroud portion has a plurality of openings formed laterally therethrough, wherein said plurality of openings are arranged in a plurality of longitudinal rows spaced about a circumference of said tubular shroud portion, and said tubular shroud portion has a rim extending radially inward from said distal end of tubular shroud portion and defining a frustoconical lead-in in coaxial alignment with said socket; and a DIN plug including:

a second connector body having a second hollow cylindrical shield configured to be received in the space between said shroud and said first hollow cylindrical shield and to make electrical contact with said first shield; and a second contact having a pin disposed coaxially within said second hollow cylindrical shield and being configured to be received within and make electrical contact with said tubular socket when said plug is inserted into said jack.

17. The DIN jack of claim 16, wherein said proximal end of said tubular shroud portion is coupled with said first connector body.

18. The DIN connector of claim 17, wherein said shroud further includes an annular base extending radially outward from said proximal end of said hollow tubular shroud body and said annular base is coupled with said first connector body.

19. The DIN connector of claim 18, wherein an annular groove is formed along an inner surface of said first cylindrical shield and said annular base of said shroud is received within said annular groove.

20. The DIN connector of claim 16, wherein the second radial gap ranges between 0.005 and 0.015 inches and the third radial gap ranges between 0.015 and 0.025 inches.

21. The DIN connector of claim 16, wherein at least some of said openings are longitudinally spaced along a length of said tubular shroud portion.

22. The DIN connector of claim 16, wherein at least some of said openings are annularly spaced about a circumference of said tubular shroud body.

23. The DIN connector of claim 20, wherein the thickness of the tubular shroud portion is about 0.010 inches.

24. The DIN connector of claim 16, wherein said one or more openings are configured to modify a dielectric constant of said shroud to support 75Ω transmission of high-speed digital and RF signals.

25. The DIN connector of claim 16, wherein said distal end of said tubular socket has an inner diameter and wherein said frustoconical lead-in has a proximal opening with a diameter no more than 0.003" larger than said inner diameter of said tubular socket and a distal opening larger than said inner diameter of said tubular socket.

26. The DIN connector of claim 16, wherein said shroud is formed of a material having a heat deflection temperature greater than 260° C. and a compression strength of at least 15 lbs.

27. The DIN connector of claim 16, wherein said shroud is formed of a liquid crystal polymer.

28. The DIN connector of claim 16, wherein said first connector body further includes a plane surface and one or more board locks protruding from said plane surface, each of said one or more board locks including at least one outwardly biased resilient finger with a rearward-facing shoulder configured to engage a bottom surface of a printed circuit board when said board lock is inserted through a hole in the printed circuit board.

29. The DIN connector of claim 28, wherein said first connector body includes a pair of said one or more board locks arranged in diagonally opposed relation relative to a longitudinal axis of said plane surface.

30. The DIN connector of claim 29, wherein said first connector body includes one or more mounting pins protruding from said plane surface in diagonally opposed relation to said one or more board locks.

* * * * *